US008726981B2

(12) United States Patent
Berry

(10) Patent No.: US 8,726,981 B2
(45) Date of Patent: May 20, 2014

(54) TANDEM PROGRESSIVE CAVITY PUMPS

(75) Inventor: Douglas W. Berry, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 380 days.

(21) Appl. No.: 13/150,309

(22) Filed: Jun. 1, 2011

(65) Prior Publication Data

US 2012/0305263 A1 Dec. 6, 2012

(51) Int. Cl.
*E21B 43/00* (2006.01)
*F04B 23/08* (2006.01)

(52) U.S. Cl.
USPC ..... 166/68.5; 166/105; 417/205

(58) Field of Classification Search
USPC ..... 166/68.5, 105; 417/62, 205
See application file for complete search history.

(56) References Cited

U.S. PATENT DOCUMENTS

| | | | | |
|---|---|---|---|---|
| 2,924,180 | A | 2/1960 | Bourke et al. | |
| 6,017,456 | A | 1/2000 | Kennedy et al. | |
| 6,082,452 | A * | 7/2000 | Shaw et al. | 166/105.5 |
| 6,092,600 | A * | 7/2000 | McKinzie et al. | 166/266 |
| 6,131,655 | A * | 10/2000 | Shaw | 166/105.5 |
| 6,131,660 | A | 10/2000 | Stuebinger et al. | |
| 6,325,143 | B1 * | 12/2001 | Scarsdale | 166/54.1 |
| 6,868,912 | B2 | 3/2005 | Proctor | |
| 7,040,878 | B2 * | 5/2006 | Denk et al. | 418/48 |
| 7,611,338 | B2 | 11/2009 | Swatek et al. | |
| 2007/0274849 | A1 | 11/2007 | Martinez | |
| 2010/0202896 | A1 | 8/2010 | Du et al. | |

* cited by examiner

*Primary Examiner* — Kenneth L Thompson
(74) *Attorney, Agent, or Firm* — Bracewell & Giuliani LLP

(57) ABSTRACT

A tandem progressive cavity pump system lifts well fluids from a production zone to a well surface. The system provides a first pump and a second pump. The system positions the first pump at the production elevation within the well, and the second pump at an intermediate elevation within the well. The system then connects a discharge of the first pump to an intake of the second pump. The system is then operated so that the first pump lifts well fluids from the production zone to the intermediate zone, depositing the well fluids in the intake of the second pump. The second pump then lifts the well fluids from the intermediate zone to the surface of the well.

18 Claims, 2 Drawing Sheets

TANDEM PROGRESSIVE CAVITY PUMPS

BACKGROUND OF THE INVENTION

1. Field of the Invention

This invention relates in general to fluid production systems and, in particular, to fluid production systems using tandem progressive cavity pumps.

2. Brief Description of Related Art

In some well completions, use of progressive cavity pumps, or progressing cavity pumps (PCPs), is preferred to produce well fluids from the completed well to the surface. The PCPs are suspended within a production zone on a string of tubing and operated to lift well fluid to the surface. PCPs may be preferred in part because they operate at lower speeds. Lower speed operation provides a costs savings due to the ability of the PCP to operate with standard equipment rather than heavily overbuilt equipment. Lower operating speeds also allow the PCPs to operate for longer periods of time without repairs or replacement. Still further, the lower operating speeds allow PCPs to handle well fluids with suspended solid matter better than other pumping systems. This is also a result of the PCP pumping mechanism which moves the fluid through the pump without flinging it against the pump stator. This decreases the stress on the pump during operation. In addition, it prevents damage to the pump caused by the impact of suspended solids on the pump housing that may cause pitting and eventual pump leakage.

Unfortunately, PCPs are unable to overcome as much head as other pump types, such as electric submersible pumps (ESPs). ESPs are typically centrifugal type pumps. Because of this, PCPs may not be used in well completions where the production zone is beyond 5,000 to 7,000 feet from the well surface. In those instances, other pump types capable of producing the well fluid to the surface, beyond the 5,000 to 7,000 feet range, must be used. This can lead to problems when the pumped fluid has a high suspended fluid content. While it is possible to use non-PCPs in wells having a high content of suspended solid matter in the well fluids, the pumps are likely to need repair and replacement at more frequent intervals. This is a result of the higher operating speeds and pumping mechanisms that may fling the suspended solids against the pump housing. More frequent repair and replacement increases the costs of production. As the time costs and production costs to continually repair or replace the downhole pump increase, the areas in which hydrocarbons may be feasibly developed are diminished due to decreased profitability margins for the well. Therefore, there is a need for a PCP that can lift well fluids beyond the standard 5,000 to 7,000 feet, thus avoiding use of ESPs.

SUMMARY OF THE INVENTION

These and other problems are generally solved or circumvented, and technical advantages are generally achieved, by preferred embodiments of the present invention that provide a tandem progressive cavity pumping system.

In accordance with an embodiment of the present invention, a method for producing hydrocarbons from a well is disclosed. The method provides a first pump and a second pump. The method then positions the first pump at a first elevation within the well, and the second pump at a second elevation within the well. The method then connects a discharge of the first pump to an intake of the second pump and operates the first and second pumps so that hydrocarbons may be produced to a surface of the well.

In accordance with another embodiment of the present invention, a fluid production system for a well is disclosed. The system includes an upper string of conduit leading from a wellhead to a first pump. The first pump is at a first elevation within a wellbore at a lower end of the upper string of conduit. The first pump has a first pump intake and a first pump discharge so that fluid flows from the first pump discharge through the upper string of conduit when the first pump operates. The system also includes a second pump at a second and lower elevation within the wellbore. The second pump has a second pump intake and a second pump discharge. A lower string of conduit leads from the intake of the first pump at the first elevation to the discharge of the second pump at the second elevation. This allows fluid to flow from the second pump discharge to the first pump intake through the lower string when the second pump operates.

In accordance with yet another embodiment of the present invention, a well fluid production system is disclosed. The well fluid production system includes a rod driven progressive cavity pump (RDPCP) at a first elevation, and a progressive cavity pump with a downhole electric motor (ESPCP) at a second elevation that is lower than the first elevation. An intake of the RDPCP connects to a discharge of the ESPCP so that the RDPCP is in the flow line of the ESPCP. This causes well fluids lifted by the ESPCP to discharge at the intake to the RDPCP, and the RDPCP to lift the well fluid from the discharge of the ESPCP to the surface.

An advantage of a preferred embodiment is that it provides a pumping system utilizing progressive cavity pumps. The disclosed progressive cavity pumping system is capable of pump lift greater than the standard pump lift of prior art progressive cavity pumps. This allows the progressive cavity pumping system to be disposed at greater wellbore depths than previous progressive cavity pumping systems.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning well drilling, drilling rig operation, well completion, and the like have been omitted inasmuch as such details are not considered necessary to obtain a complete understanding of the present invention, and are considered to be within the skills of persons skilled in the relevant art.

Figure 1:
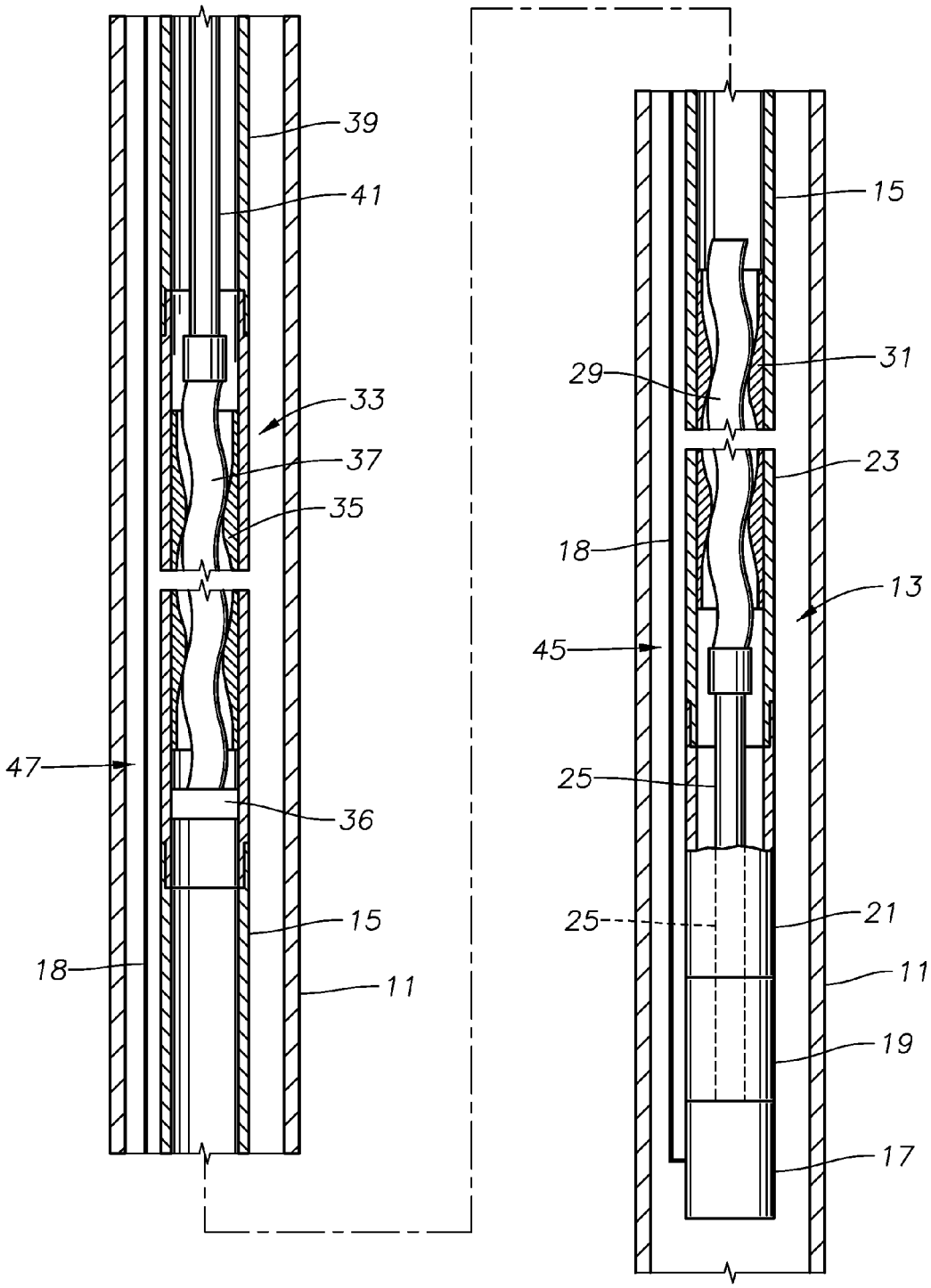
FIG. 1 is schematic representation of a portion of a fluid production system in accordance with an embodiment of the present invention.

Referring to FIG. 1, a well having a casing string 11 disposed within the well is shown. Casing 11 may be perforated at a lower end for allowing well fluid to enter. An electric submersible progressive cavity pump or progressing cavity pump assembly (ESPCP) 13 is disposed within casing 11 at the end of a first tubing string 15. ESPCP 13 may include an electric motor 17, a seal section 19, a gear box 21, and a pump 23. A flexshaft 25 may extend from motor 17 through seal section 19 and gear box 21 to pump 23. There flexshaft 25 may couple to an ESPCP rotor 29 positioned within ESPCP stator 31. ESPCP rotor 29 may rotate in response to rotation of flexshaft 25 causing fluid to enter pump 23 and be moved downstream through tubing string 15. A power cable 18 may run from the surface of the well to electric motor 17 to provide voltage to motor 17 for operation of ESPCP 13. Power cable 18 runs alongside tubing string 15.

First tubing string 15 may extend from a discharge of ESPCP 13 to an intake of a rod driven progressive cavity pump or progressing cavity pump assembly (RDPCP) 33. RDPCP 33 may include an RDPCP stator 35 and an RDPCP rotor 37. RDPCP stator 35 may couple to an upper end of first tubing string 15 such that fluid flow downstream through first tubing string 15 may flow into the intake of RDPCP 33. RDPCP stator 35 may have a lower end that is open to first tubing string 15 so that RDPCP stator 35 is in the flow line of ESPCP 13, i.e. fluid in first tubing string 15 may flow directly into RDPCP stator 35. A person skilled in the art may understand that tubing string 15 may be quite long, upwards of several thousand feet. In the illustrated embodiment, first tubing string 15 may be as long as 7,000 feet. A second string of tubing 39 may couple to the discharge of RDPCP 33 and extend to a surface. Well fluids may flow from RDPCP 33 to the surface through second string of tubing 39. RDPCP 33 may include RDPCP rotor 37 positioned within and configured to rotate within RDPCP stator 35 to move fluids through RDPCP 33. A drive rod 41 may couple to RDPCP rotor 37 and extend to the surface of the well. There, drive rod 41 may further couple to a motor, such as an electric engine or combustion engine, adapted to rotate drive rod 41.

Figure 2:
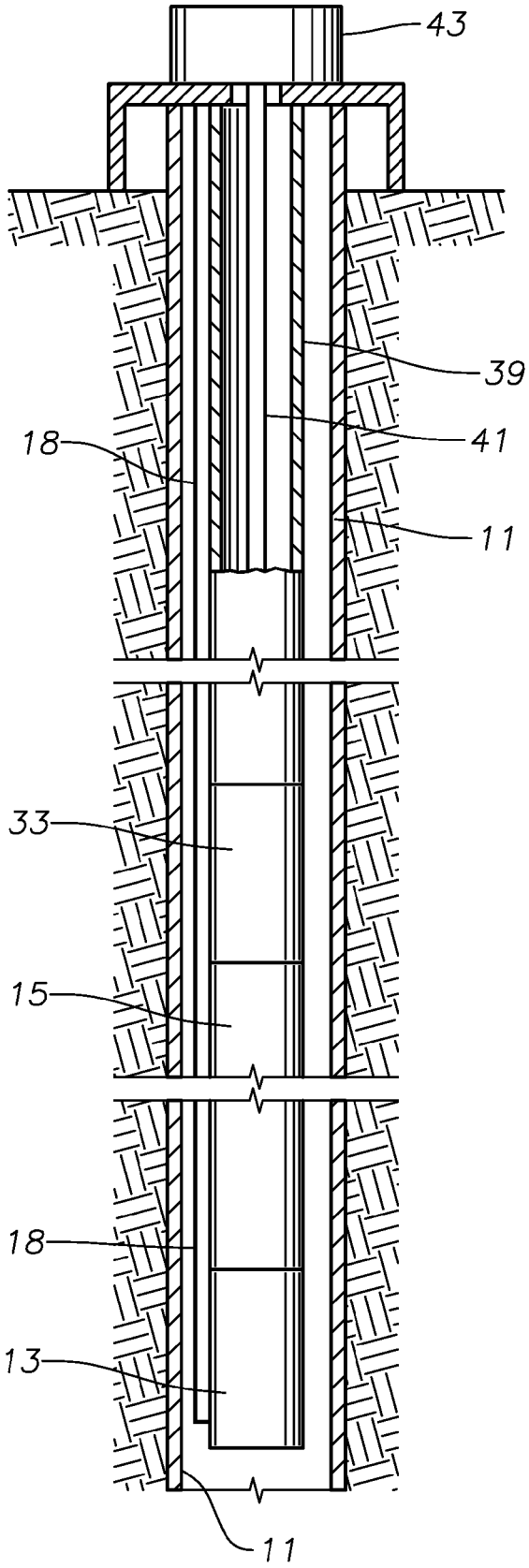
FIG. 2 is a schematic representation of additional components of the fluid production system of FIG. 1.

Referring to FIG. 2, drive rod 41 may extend to the surface of the well where drive rod 41 may be coupled to a drive head 43. A person skilled in the art may understand that drive rod 41 may comprises multiple shafts coupled together so that each shaft may rotate in response to rotation of the previous shaft. Drive head 43 may include a bearing box and an electric motor. Drive head 43 may be positioned in any suitable manner such that operation of the electric motor within drive head 43 may cause rotation of drive rod 41. Drive head 43 may include any suitable motor, such as a gas powered or electric motor. As drive head 43 causes rotation of drive rod 41, drive rod 41 may, in turn, rotate RDPCP rotor 37 within RDPCP stator 35.

As well operations move from completion to production, ESPCP 13 may be lowered into casing 13 to a production zone 45. Production zone 45 may be at a significant depth within the well, perhaps up to 14,000 feet. ESPCP 13 may not have sufficient pumping head to produce fluids from production zone 45 to the surface of the well. As ESPCP 13 is lowered into the well, first tubing string 15 may be coupled to and run into the well so that ESPCP 13 may move well fluids downstream through first tubing string 15. After running first tubing string 15 in for a sufficient length, such as 5,000 to 7,000 feet, RDPCP stator 35 may be coupled to a downstream end of first tubing string 15 opposite ESPCP 13. Second tubing string 39 may then be coupled to RDPCP stator 35 opposite ESPCP 13. Second tubing string 39 may be run into casing 11 until ESPCP 13 is at production zone 45, and RDPCP 33 is at an intermediate zone 47 within the well. Second string of tubing 39 may be hung from a tubing hanger so that RDPCP 33 and ESPCP 13 are suspended within casing 11. Following landing and setting of second string of tubing 39, RDPCP rotor 37 may be run into the well on drive rod 41 and landed on a tag bar 36. Tag bar 36 may be mounted to RDPCP stator 35 or first string of tubing 15 so that when RDPCP rotor 37 lands on tag bar 36, RDPCP rotor 37 may be positioned within RDPCP stator 35. Drive rod 41 may then be coupled to drive head 43.

In operation, ESPCP 13 may operate through electrical power to lift well fluids from production zone 45 to intermediate zone 47. There, the well fluids lifted by ESPCP 13 may discharge into the intake of RDPCP 33. RDPCP 33 may then operate to lift the well fluids from intermediate zone 47 to the surface of the well. In this manner, well fluids may be lifted from the well from depths greater than the maximum pumping lift of the progressive cavity pump (PCP) located in the production zone at the bottom of the well. A person skilled in the art may understand that the present invention may be modified to utilize alternative pump types in the positions of ESPCP 13 and RDPCP 33. The disclosed embodiments contemplate and include such modifications.

Accordingly, the disclosed embodiments provide numerous advantages. For example, the disclosed embodiments provide a pumping system that allows for use of PCP pumps at depths greater than the maximum pumping head of modern PCP pumps. This is advantageous because the PCP pumps are more forgiving and can produce fluids with suspended solid matter with less wear and tear to the pump. In turn, this allows for longer life of the PCP and, consequently, longer and lower-cost production periods from the well.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A method for producing fluids from a well, the method comprising:

(a) providing a lower pump and an upper pump, the lower pump being a progressing cavity pump driven by an electric motor mounted below the lower pump, the upper pump being a progressing cavity pump driven by a rotatable drive rod;

(b) securing the lower pump and motor to a lower end of a lower section of tubing;

(c) securing a lower end of the upper pump to an upper end of the lower section of tubing;

(d) connecting a discharge of the upper pump to an upper section of tubing extending to a wellhead and extending the rod downward from the wellhead through the upper section of tubing to the upper pump; then (e) operating the lower pump to cause all of the fluid pumped by the lower pump to flow from the lower pump to the upper pump; and (f) rotating the drive rod to cause fluid to flow from the upper pump to the wellhead.

2. The method of claim 1, wherein steps (b) and (c) comprise providing an annulus between the lower string of tubing and casing of the well that is continuous and open from the lower pump to the upper pump.

3. The method of claim 1, wherein steps (b) and (c) comprise providing a flow passage through the lower section of tubing from the lower pump to the upper pump that is free of any outlets.

4. The method of claim 1, wherein:

steps (b), (c) and (d) comprise extending a power cable from the wellhead alongside an entire length of the lower section of tubing to the motor of the lower pump.

5. The method of claim 1, wherein:

steps (b) and (c) comprise providing an annulus between the upper and lower strings of tubing and casing of the well that is continuous and open from the lower pump to the wellhead; and steps (b), (c) and (d) comprise extending a power cable from the wellhead alongside an entire length of the upper and lower sections of tubing to the motor of the lower pump.

6. The method of claim 1, wherein steps (a), (b) and (c) comprise positioning the lower pump in the well at a depth below 7000 feet.

7. The method of claim 1, wherein step (b) comprises:

providing a length of at least 5000 feet for the lower section of tubing.

8. The method of claim 1, wherein steps (a), (b) and (c) comprise:

providing a length of at least 5000 feet for the lower section of tubing; and positioning the lower pump in the well at a depth below 7000 feet.

9. A fluid production system for a well comprising:

an upper string of conduit leading from a wellhead to an upper pump, the upper pump being a progressing cavity pump driven a rotatable drive rod that extends downward through the conduit from the wellhead to the upper pump;

the upper pump being at an upper elevation within a wellbore at a lower end of the upper string of conduit, the upper pump having an upper pump intake and an upper pump discharge so that fluid flows from the upper pump discharge through the upper string of conduit when the upper pump operates;

a lower pump at a lower elevation within the wellbore, the lower pump being a progressing cavity pump coupled to an electrical motor located below the lower pump, the lower pump having a lower pump intake and a lower pump discharge; and as lower string of conduit leading directly from the upper pump intake to the lower pump discharge, the lower string of conduit between the lower pump to the upper pump being free of any outlets so that all fluid pumped by the lower pump flows from the lower pump discharge to the upper pump intake through the lower string of conduit when the lower pump operates.

10. The fluid production system of claim 9, an open and continuous annulus between the lower string of conduit and casing within the wellbore.

11. The fluid production system of claim 9, further comprising a power cable extending continuously along side the lower section of conduit from the upper pump to the motor of the lower pump.

12. The fluid production system of claim 11, further comprising:

an annulus between the upper and lower strings of conduit and casing in the wellbore, the annulus being open and continuous from the wellhead to the motor of the lower pump; and a power cable extending from the wellhead through the annulus alongside an entire length of the upper and lower strings of conduit to the motor of the lower pump.

13. The fluid production system of claim 12, wherein the lower pump is located within the well at a depth in excess of 7000 feet.

14. The fluid production system of claim 12, wherein:

the lower section of tubing has a length of at least 5000 feet; and the combined length of the lower and lower sections of tubing is greater than 7000 feet.

15. A well fluid production system comprising:

a rod driven progressive cavity pump (RDPCP) at an upper elevation;

a progressive cavity pump with a downhole electric motor (ESPCP) at a lower elevation that is lower than the upper elevation; and wherein an intake of the RDPCP connects directly to a discharge of the ESPCP so that the RDPCP is in the flow line of the ESPCP, causing all well fluid lifted by the ESPCP to discharge at the intake to the RDPCP, and the RDPCP to lift the well fluid from the discharge of the ESPCP to a wellhead at the surface.

16. The well fluid production system of claim 15, wherein a distance from the ESPCP to the RDPCP is at least 5000 feet.

17. The well fluid production system of claim 16, wherein the lower elevation is at least 7000 feet.

18. The well fluid production system of claim 15, further comprising:

an annulus in the well that is open and continuous from the wellhead to the ESPCP;

a power cable extending continuously through an entire length of the annulus from the wellhead to the ESPCP.

* * * * *

UNITED STATES PATENT AND TRADEMARK OFFICE

CERTIFICATE OF CORRECTION

PATENT NO. : 8,726,981 B2
APPLICATION NO. : 13/150309
DATED : May 20, 2014
INVENTOR(S) : Douglas W. Berry It is certified that error appears in the above-identified patent and that said Letters Patent is hereby corrected as shown below:

In the Specification

Column 3, line 56, delete “comprises” and insert --comprise--
Column 6, line 6, delete “as” and insert --a--

Signed and Sealed this
Ninth Day of December, 2014

Michelle K. Lee

Michelle K. Lee
*Deputy Director of the United States Patent and Trademark Office*